US007581786B1

(12) United States Patent
Wang

(10) Patent No.: US 7,581,786 B1
(45) Date of Patent: Sep. 1, 2009

(54) COMBINATION CHAIR

(76) Inventor: Wen-Tsan Wang, 6F., No. 300, Jui Kuang Road, Taipei city (TW)

( * ) Notice: Subject to any disclaimer, the term of this patent is extended or adjusted under 35 U.S.C. 154(b) by 0 days.

(21) Appl. No.: 12/335,492

(22) Filed: Dec. 15, 2008

(51) Int. Cl.
*A47C 7/62* (2006.01)
*A47C 7/00* (2006.01)

(52) U.S. Cl. ..... 297/188.11; 297/400.1; 297/DIG. 6

(58) Field of Classification Search ..... 297/440.12, 297/188.1, 217.11, 423.41, 462, 16.1, DIG. 6, 297/440.1; 206/216, 577; 229/117.07; 220/4.28, 220/23.86
See application file for complete search history.

(56) References Cited

U.S. PATENT DOCUMENTS 3,640,575 A * 2/1972 Dosi ..... 297/440.12
4,883,317 A * 11/1989 Davenport ..... 297/188.1
6,050,410 A * 4/2000 Quirion ..... 206/386

* cited by examiner

*Primary Examiner*—Milton Nelson, Jr.
(74) *Attorney, Agent, or Firm*—Leong C. Lei

(57) ABSTRACT

A combination chair includes a chair body, which has a front opening, a hard bottom board supported on the flexible bottom panel of the chair body, two reinforcing plates detachably connected between the front and back panels of the chair body by hook and loop materials, a hard top board supported on the reinforcing plates, a cover member covered on the chair body for a person to sit thereon, and a storage box inserted through the front opening into the inside of the chair body between the two reinforcing plates for keeping things.

2 Claims, 4 Drawing Sheets

COMBINATION CHAIR

BACKGROUND OF THE INVENTION (a) Technical Field of the Invention

The present invention relates to chairs and more particularly, to a combination chair that has a storage box detachably inserted therein for keeping things.

(b) Description of the Prior Art

Many storage devices are commercially available. These storage devices include two types, i.e., the fixed type and the collapsible type. Regular fixed type storage devices commonly have a frame structure made of metal, wood, plastics, or other hard or rigid materials. Because a fixed type storage device is not collapsible, it occupies much storage space when not in use. A collapsible type storage device can be received in a collapsed status to reduce space occupation when not in use. Flexible sheet materials may be used for making collapsible type storage devices. Further, hinge means may be used in a collapsible type storage device to connect hard members. Either fixed type or collapsible type, a conventional storage device is simply used to keep things.

SUMMARY OF THE INVENTION

The primary purpose of the present invention is to provide a combination chair, which is folding collapsible. It is another object of the present invention to provide a combination chair, which has a storage box inserted therein for keeping things. It is still another object of the present invention to provide a combination chair with a storage box therein, which provides a bottom buffer space to avoid jamming of the storage box in the chair body.

To achieve these and other objects of the present invention, a combination chair comprises a box-like chair body, a storage box movable in and out of the box-like chair body for keeping things, and a cover covered on the box-like chair body for a person to sit thereon.

Further, the box-like chair body comprises a front panel, which has an opening through which the storage box is moved in and out of the box-like chair body, a back panel opposing the front panel, two folding side panels connected between the front panel and the back panel at two opposite lateral sides, and two collapsible flexible bottom panels arranged in a stack and horizontally fastened to the front panel, the back panel and the side panels at a bottom side. Further, each side panel has a vertically extending middle folding line. By means of the folding lines, the box-like chair body can be folded into a collapsed flat manner.

Further, a hard bottom board is supported on the two collapsible flexible bottom panels, and two reinforcing plates are inserted into the box-like chair body and detachably connected between the front panel and the back panel in a parallel manner and supported on the hard bottom board. Each reinforcing plate has two end flanges respectively detachably fastened to the front panel and the back panel by hook and loop materials. Further, a hard top board is supported on the collapsible flexible reinforcing plates.

Further, the storage box has a folding collapsible structure similar to the box-like chair body. Therefore, the storage box can be folded up and set in a collapsed flat manner when not in use.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
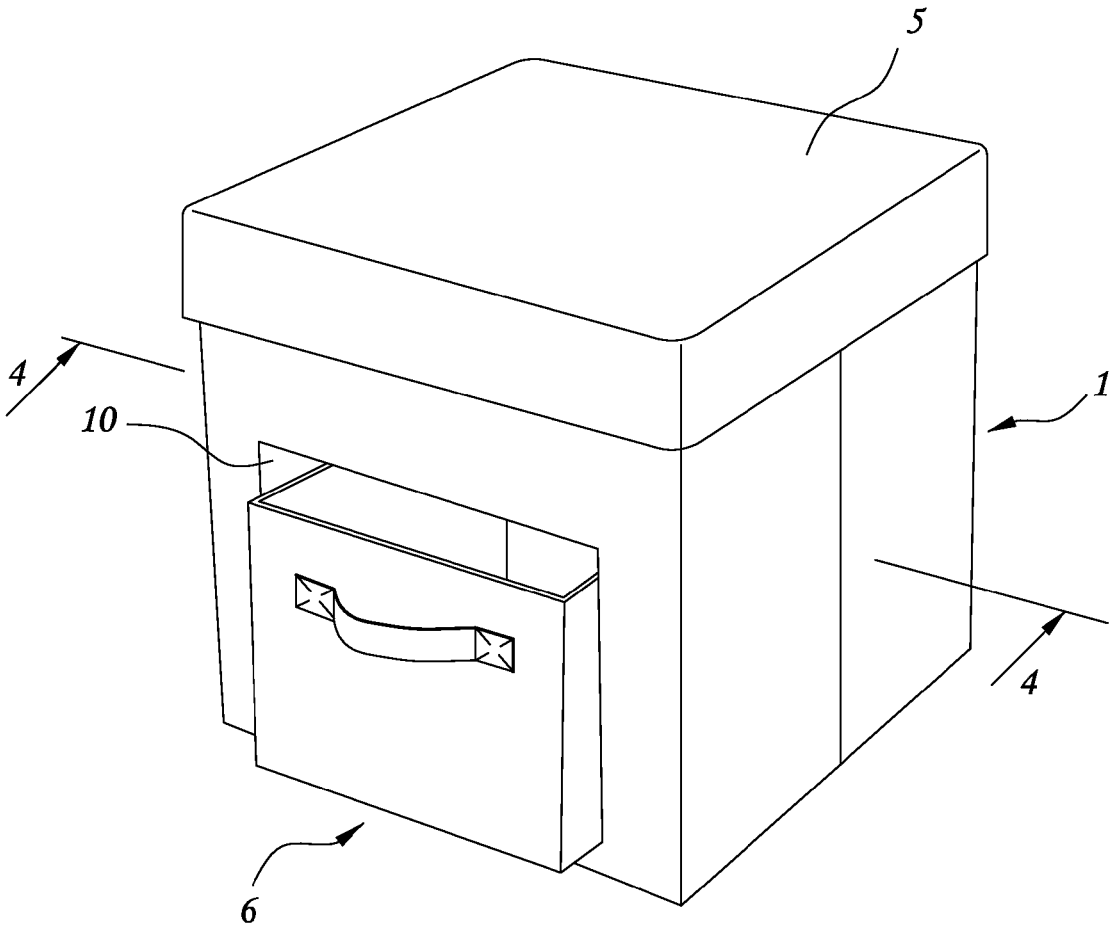
FIG. 1 is an elevational view of a combination chair in accordance with the present invention.
Figure 2:
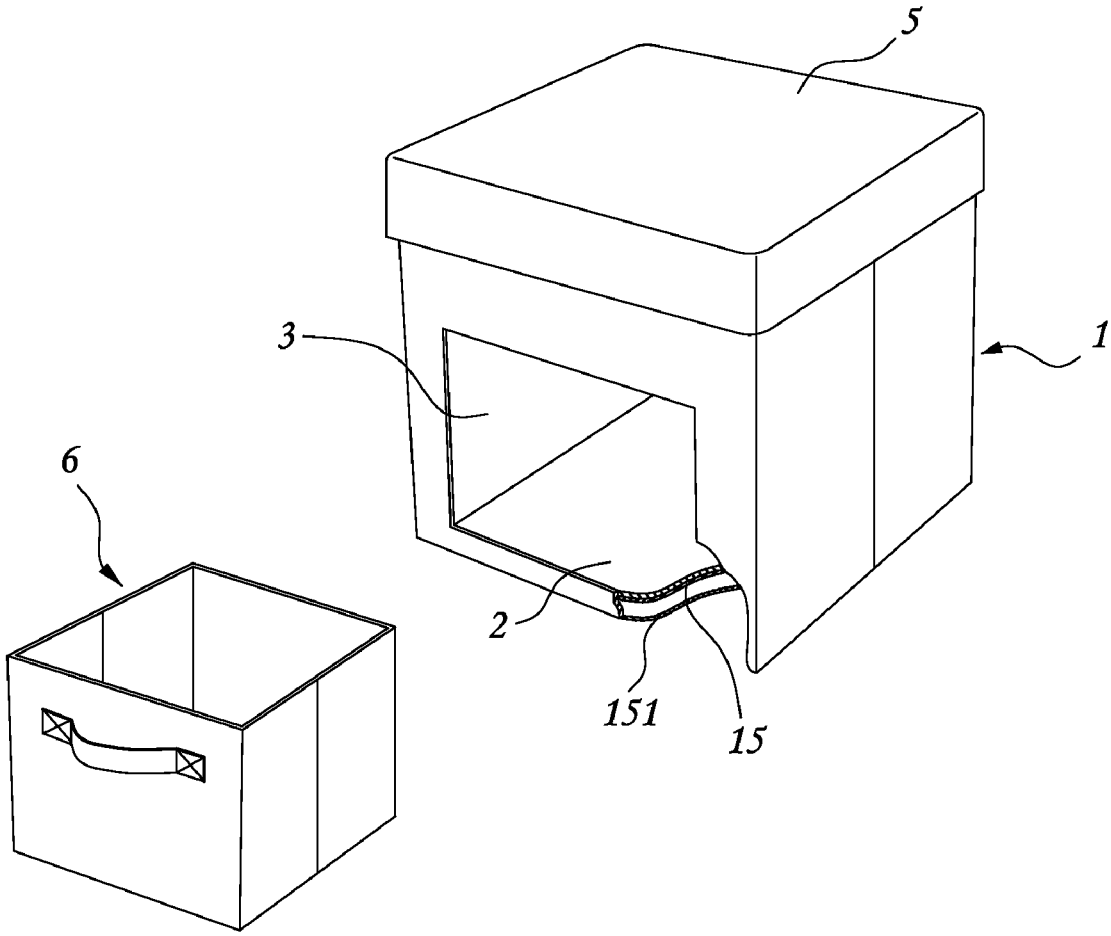
FIG. 2 is a cutaway view of the combination chair in accordance with the present invention.

Referring to FIGS. 1 and 2, a combination chair in accordance with the present invention comprises a chair body 1, which has an opening 10 in its front side, a storage box 6 inserted through the opening 10 into the inside of the chair body 1 and kept in flush with the front side of the chair body 1, and a cover member 5 covered on the top side of the chair body 1 for a person to sit thereon.

Figure 3:
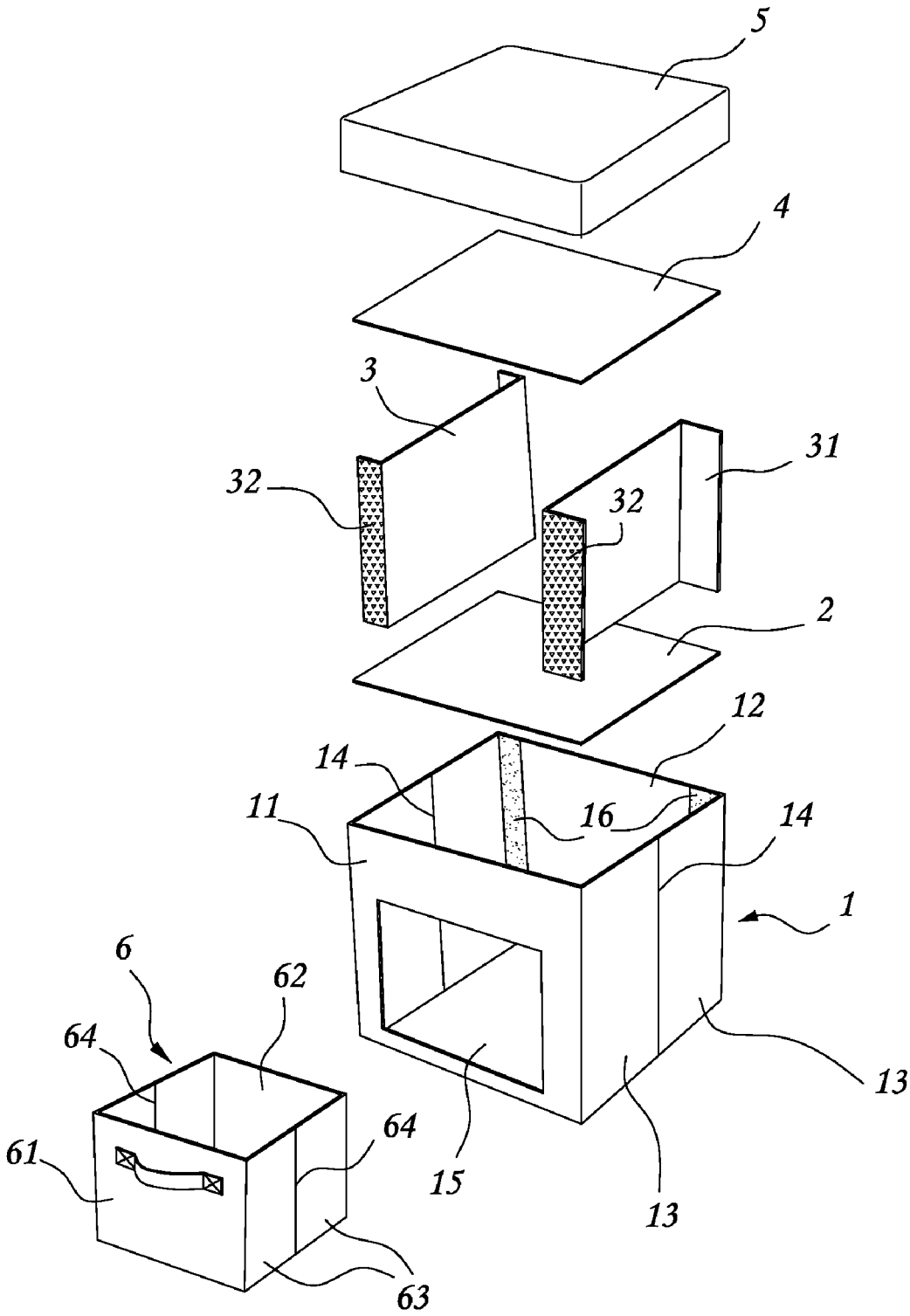
FIG. 3 is an exploded view of the combination chair in accordance with the present invention.
Figure 4:
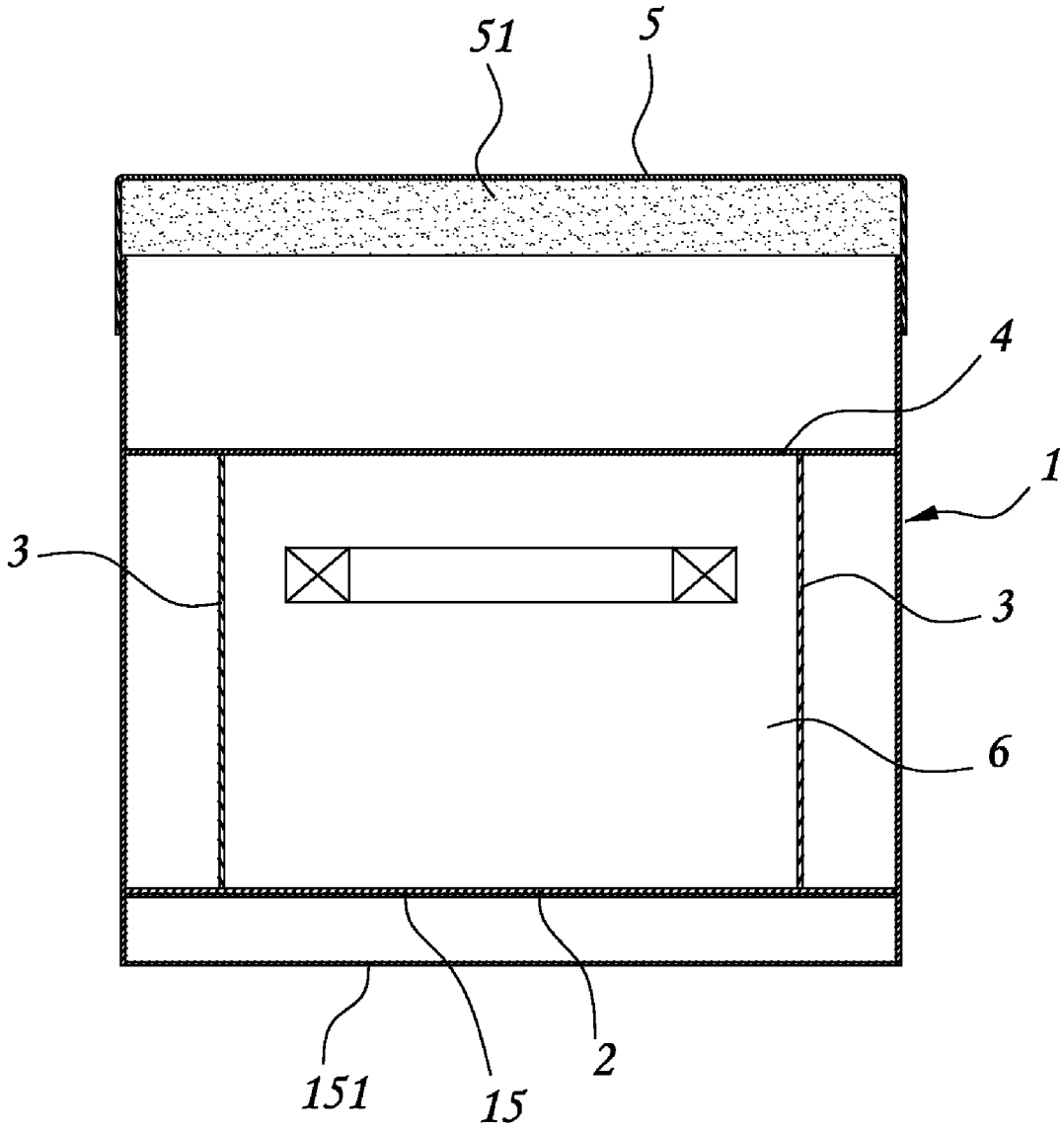
FIG. 4 is a sectional view of the combination chair in accordance with the present invention.

Referring to FIG. 3 and FIG. 2 again, the chair body 1 is a top-open type rectangular container having a front panel 11, a back panel 12 opposing the front panel 11, and two side panels 13 connected between the front panel 11 and the back panel 12 at two opposite lateral sides, and two flexible bottom panels 15 and 151 arranged in a stack and horizontally fastened to the front panel 11, the back panel 12 and the side panels 13 at the bottom side. The front panel 11, the back panel 12 and the side panels 13 can be respectively made of one or two hard boards and wrapped with a cloth. Each side panel 13 has a folding line 14 vertically disposed on the middle. Through the folding lines 14, the side panels 13 can be respectively folded up to collapse the chair body 1 into a flat manner. Further, the aforesaid opening 10 is formed in the front panel 11. The chair body 1 further comprises a hard bottom board 2 supported on the upper flexible bottom panel 15, two reinforcing plates 3 detachably connected between the front panel 11 and the back panel 12 in a parallel manner for guiding sliding of the storage box 6 through the opening 10 in and out of the chair body 1, and a hard top board 4 supported on the two reinforcing plates 3. Each reinforcing plate 3 has two end flanges 31. The end flanges 31 are respectively provided with a male fastening member (or female fastening member) 32. Further, female fastening members (or male fastening members) 16 are respectively bilaterally provided at the inner wall of the front panel 11 and the inner wall of the back panel 12 for securing the male fastening member (or female fastening member) 32 at the end flanges 31 of the reinforcing plates 3. The female fastening members (or male fastening members) 16 and the male fastening member (or female fastening member) 32 can be hook and loop materials. Referring to FIG. 4, for sitting comfort, the cover member 5 is stuffed with a soft stuffing material 51 under the soft covering thereof.

Referring to FIG. 3 again, the storage box 6 is folding collapsible, comprising a front panel 61, a back panel 62, two side panels 63 connected between the front panel 61 and the back panel 62 at two opposite lateral sides, and a flexible bottom panel (not shown) horizontally fastened to the front panel 61, the back panel 62 and the side panels 62 at the bottom side. Each side panel 63 has a vertical folding line 64 on the middle. Through the veitical folding lines 64, the side panels 63 can be folded up to collapse the storage box 6. Further, the front panel 61 of the storage box 6 can be provided with a handle.

Referring to FIGS. 2 and 4 again, the two flexible bottom panels 15 and 151 provide a buffer space. When a person sits on the cover member 5, the two flexible bottom panels 15 and 151 can be curved downwards to buffer the pressure, avoiding jamming of the storage box 6 in the chair body 1. A prototype of combination chair has been constructed with the features of FIGS. 1~4. The combination chair functions smoothly to provide all of the features disclosed earlier.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A combination chair, comprising:

a chair body, said chair body comprising a front panel, said front panel comprising an opening, a back panel opposing said front panel, two folding side panels connected between said front panel and said back panel at two opposite lateral sides, two collapsible flexible bottom panels arranged in a stack and horizontally fastened to said front panel, said back panel and said side panels at a bottom side;

a hard bottom board supported on said two collapsible flexible bottom panels;

two reinforcing plates inserted into said box like chair body and detachably connected between said front panel and said back panel in a parallel manner and supported on said hard bottom board, each said reinforcing plate comprising two end flanges respectively detachably fastened to said front panel and said back panel by hook and loop materials;

a hard top board supported on said reinforcing plates;

a cover member covering said chair body and supported on said front panel, said back panel and said side panels; and a storage box inserted through said opening into the inside of said chair body and kept in flush with said front panel.

2. The combination chair as claimed in claim 1, wherein said cover member is stuffed with a soft stuffing material under a soft covering thereof.

* * * * *